US008776810B2

(12) United States Patent
Lah et al.

(10) Patent No.: US 8,776,810 B2
(45) Date of Patent: Jul. 15, 2014

(54) STICK WITH CAM LEVER TYPE LOCKING DEVICE

(75) Inventors: Jeh-Kun Lah, Seoul (KR); Jang-Ho Wang, Uiwang-si (KR)

(73) Assignee: Jeh-Kun Lah, Jongno-gu, Seoul (KR)

( * ) Notice: Subject to any disclaimer, the term of this patent is extended or adjusted under 35 U.S.C. 154(b) by 72 days.

(21) Appl. No.: 13/476,071

(22) Filed: May 21, 2012

(65) Prior Publication Data

US 2012/0305041 A1 Dec. 6, 2012

(30) Foreign Application Priority Data

Jun. 2, 2011 (KR) ..... 20-2011-0004853 U

(51) Int. Cl.
*A45B 3/12* (2006.01)
*A63C 11/22* (2006.01)

(52) U.S. Cl.
USPC ..... 135/75; 135/65; 135/76; 280/823; 403/109.1; 403/374.5

(58) Field of Classification Search
USPC ..... 135/65, 72, 75, 76; 280/819–823, 816; 403/109.1, 109.5, 109.8, 110, 374.2, 403/374.5, 377, 397; 248/218.4, 219.2, 248/227.1, 229.1, 228.2, 230.2, 230.6, 248/188.5, 539, 551
See application file for complete search history.

(56) References Cited

U.S. PATENT DOCUMENTS

| | | | | |
|---|---|---|---|---|
| 2,817,548 | A * | 12/1957 | Uthemann | 403/104 |
| 4,596,484 | A * | 6/1986 | Nakatani | 403/104 |
| 5,154,449 | A * | 10/1992 | Suei-Long | 285/298 |
| 6,142,698 | A * | 11/2000 | Nutter | 403/109.1 |
| 6,749,227 | B2 * | 6/2004 | Margid | 280/823 |
| 7,244,070 | B2 * | 7/2007 | Burnett et al. | 396/420 |
| 7,293,934 | B1 * | 11/2007 | Huang | 403/109.1 |
| 7,600,734 | B2 * | 10/2009 | Clarke | 248/519 |
| 8,006,711 | B2 * | 8/2011 | Pietrzak et al. | 135/75 |
| 8,075,217 | B2 * | 12/2011 | Eason | 403/109.1 |
| 2004/0101351 | A1 * | 5/2004 | Pitcher | 403/109.5 |
| 2005/0126612 | A1 * | 6/2005 | Chen | 135/16 |
| 2007/0108756 | A1 * | 5/2007 | Laakso et al. | 280/823 |

* cited by examiner

*Primary Examiner* — Winnie Yip
(74) *Attorney, Agent, or Firm* — Nixon Peabody LLP; Jeffrey L. Costellia

(57) ABSTRACT

A stick is provided in which a gripping tube is fixed to a front end portion of an upper connection tube having a large diameter and a circular-arc engagement portion formed by a front-end cut portion of the gripping tube is tightened or loosened with the operation of a cam lever so that the outer periphery of a lower connection tube is fixed in a pressurized and gripped state or the pressurizing force is released, wherein a contracted tube portion is formed in the outer periphery of the lower connection tube at the portion with which the circular-arc engagement portion comes into contact when the lower connection tube is pressed into the upper connection tube so as to reach a shortened position, and when the cam lever is locked at the shortened position, the circular-arc engagement portion comes into contact with the contracted tube portion having a small outer diameter.

3 Claims, 8 Drawing Sheets

STICK WITH CAM LEVER TYPE LOCKING DEVICE

CROSS-REFERENCE TO RELATED APPLICATION

This application claims priority to Korean Patent Application No. 20-2011-0004853, filed on Jun. 2, 2011, and all the benefits accruing therefrom under 35 U.S.C. §119, the contents of which in its entirety are herein incorporated by reference.

BACKGROUND

1. Field

The present disclosure relates to a stick with a cam lever type locking device, and more particularly, to a stick with a cam lever type locking device capable of preventing a decrease in the locking force exerted when the stick is normally used by preventing the plastic deformation of an engagement portion in a manner such that the locking force applied to the engagement portion of the locking device is decreased when the stick is accommodated in a shortened state for a long period of time.

2. Description of the Related Art

In general, a stick is used as assisting means for supporting a body of a user, for example, in the case of climbing, sport games, or walking of a patient. Such a stick has a configuration in which a handle is provided in the end portion of a pole shaft. The pole shaft is generally configured by inserting and connecting plural connection tubes to each other, whereby the pole shaft may be shortened or lengthened in a so-called 'telescopic type' or an 'antenna type' when the pole shaft is accommodated and used.

Among locking devices which fix the stick in a lengthened state or a shortened state, there is a known cam lever type locking device having a configuration in which a stick is locked by allowing an engagement portion to pressurize and grip the outer periphery of a connection tube with the operation of a cam lever, which may be conveniently operated by a woman or an aged person.

FIG. 1 is a diagram illustrating an example of a stick which adopts such a locking device.

In FIG. 1, the stick includes plural connection tubes 2, 4, 6, . . . , where among the adjacent connection tubes, the connection tube having a large diameter is referred to as an 'upper connection tube' and the connection tube having a small diameter is referred to as a 'lower connection tube'.

A cam lever type locking device 10 is applied to at least one or more points of the connection portions of the adjacent connection tubes 2, 4, 6 . . . and a general button type locking device 12 is used together. At the time of applying the button type locking device 12, a sleeve 4*a* is installed at the front end portion of the upper connection tube 4.

Referring to FIG. 1, the connection tube includes three stages of connection tubes. The cam lever type locking device 10 is applied to the first-stage upper connection tubes 2 and the second-stage lower connection tube 4, and the button type locking device 12 is applied to the second-stage upper connection tube 4 and the third-stage lower connection tube 6. Alternatively, the cam lever type locking device 10 may be applied to all of the first-stage and second-stage connection tubes and the second-stage and third-stage connection tubes.

FIG. 2 illustrates an example of the cam lever type locking device.

In the cam lever type locking device 10 shown in FIG. 2, a gripping tube 20 is fixed to the end portion of the upper connection tube 2 having a large diameter, and a tightening plate 24 extends to a portion where a part of the front end portion of the gripping tube 20 is cut as a cut portion 22. A cam lever 40 is installed in the tightening plate 24 through an operation pin 30 and a hinge pin 50. When the cam lever 40 is pressed downward, the cam surface 42 of the cam lever 40 pulls two tightening plates 24, so that a circular-arc engagement portion 23 of the gripping tube 20 pressurizes and grips the outer periphery of the lower connection tube 4.

Further, FIG. 3 illustrates another example of the cam lever type locking device.

In a cam lever type locking device 100 shown in FIG. 3, a gripping tube 120 is fixed to the end portion of the upper connection tube 2 having a large diameter. A cam lever 140 is installed through an operation pin 130 and a hinge pin 150 by cutting both sides of the front end portion of the gripping tube 120 as a cut portion 122. When the cam lever 140 is pressed downward so as to rotate a cam surface 142, two circular-arc engagement portions 123 are tightened so as to pressurize and grip the outer periphery of the lower connection tube 4.

Incidentally, even in a case where the stick is accommodated in a shortened state, the lower connection tube needs to be fixed so as not to be separated by pressing the cam lever 40, 140. That is, the lower connection tube 4 is pressed into the upper connection tube 2 until the sleeve 4*a* (see FIG. 1) of the front end of the lower connection tube 4 contacts the front end of the upper connection tube 2, and then the cam lever 40, 140 is pressed so as to fix the lower connection tube 4 (see FIG. 1) in a pressurized and gripped state.

Accordingly, during a time in which the stick is accommodated, the engagement portion 23, 123 of the gripping tube 20, 120 pressurizes the outer periphery of the lower connection tube 4. The gripping tube 20, 120 is formed of metal or plastic, and especially in the case of plastic, when the state in which the gripping tube 20, 120 pressurizes and fixes the lower connection tube 4 is maintained for a long period of time, the engagement portion 23, 123 which receives a reaction force undergoes plastic deformation. That is, the circular-arc portion of the engagement portion is stretched. Such plastic deformation may decrease the locking force of the stick, so that a problem arises in that the lower connection tube 4 enters into the upper connection tube 2 when pressing the stick against the ground.

SUMMARY

The present disclosure is directed to providing a stick with a cam lever type locking device capable of preventing a decrease in the locking force when the stick is normally used by preventing the plastic deformation of an engagement portion in a manner such that a locking force applied to the engagement portion of the locking device is decreased in a state where the stick is shortened.

In one aspect, there is provided a stick in which a gripping tube is fixed to a front end portion of an upper connection tube having a large diameter and a circular-arc engagement portion formed by a front-end cut portion of the gripping tube is tightened or loosened with the operation of a cam lever so that the outer periphery of a lower connection tube is fixed in a pressurized and gripped state or the pressurizing force is released, wherein a contracted tube portion having a diameter smaller than the outer diameter of the lower connection tube and having a width wider than the axial length of the circular-arc engagement portion is formed in the outer periphery of the lower connection tube at the portion with which the circular-arc engagement portion comes into contact when the lower connection tube is pressed into the upper connection tube so as to reach a shortened position, and when the cam lever is locked at the shortened position, the circular-arc engagement portion comes into contact with the contracted tube portion having a small outer diameter.

The contracted tube portion may be formed in a manner such that the outer periphery of the lower connection tube is cut so as to be recessed without any change in the inner diameter thereof or may be formed in a manner such that the front end portion of the manufactured lower connection tube is pressurized and contracted so as to directly decrease the inner and outer diameters thereof.

BRIEF DESCRIPTION OF THE DRAWINGS

The above and other aspects, features and advantages of the disclosed exemplary embodiments will be more apparent from the following detailed description taken in conjunction with the accompanying drawings in which.

DETAILED DESCRIPTION

Exemplary embodiments now will be described more fully hereinafter with reference to the accompanying drawings, in which exemplary embodiments are shown.

Figure 1:
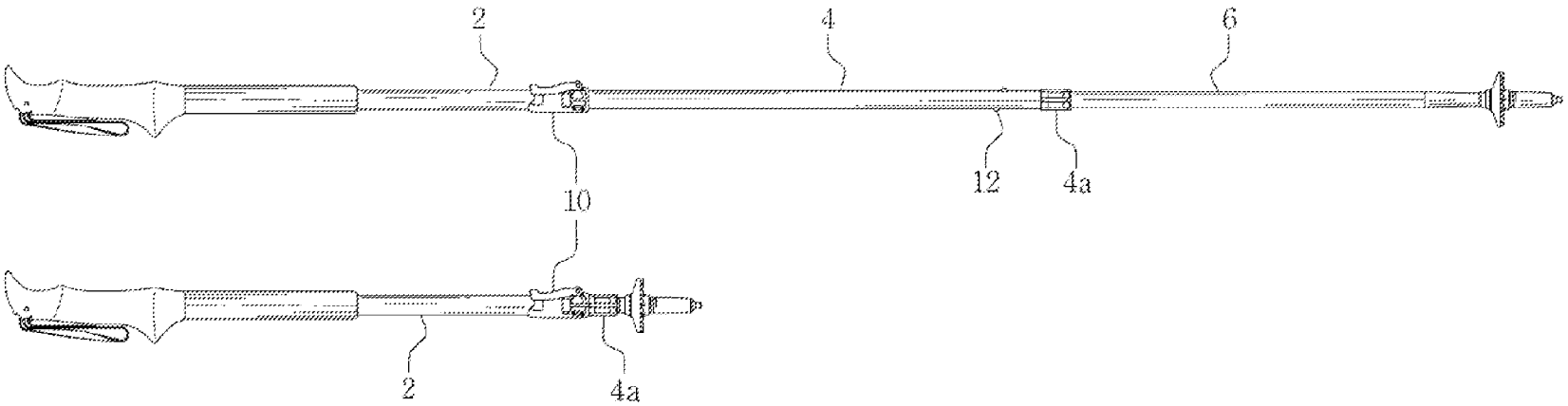
FIG. 1 (PRIOR ART)
FIG. 1 is a diagram illustrating an entire structure of a general stick.
Figure 3:
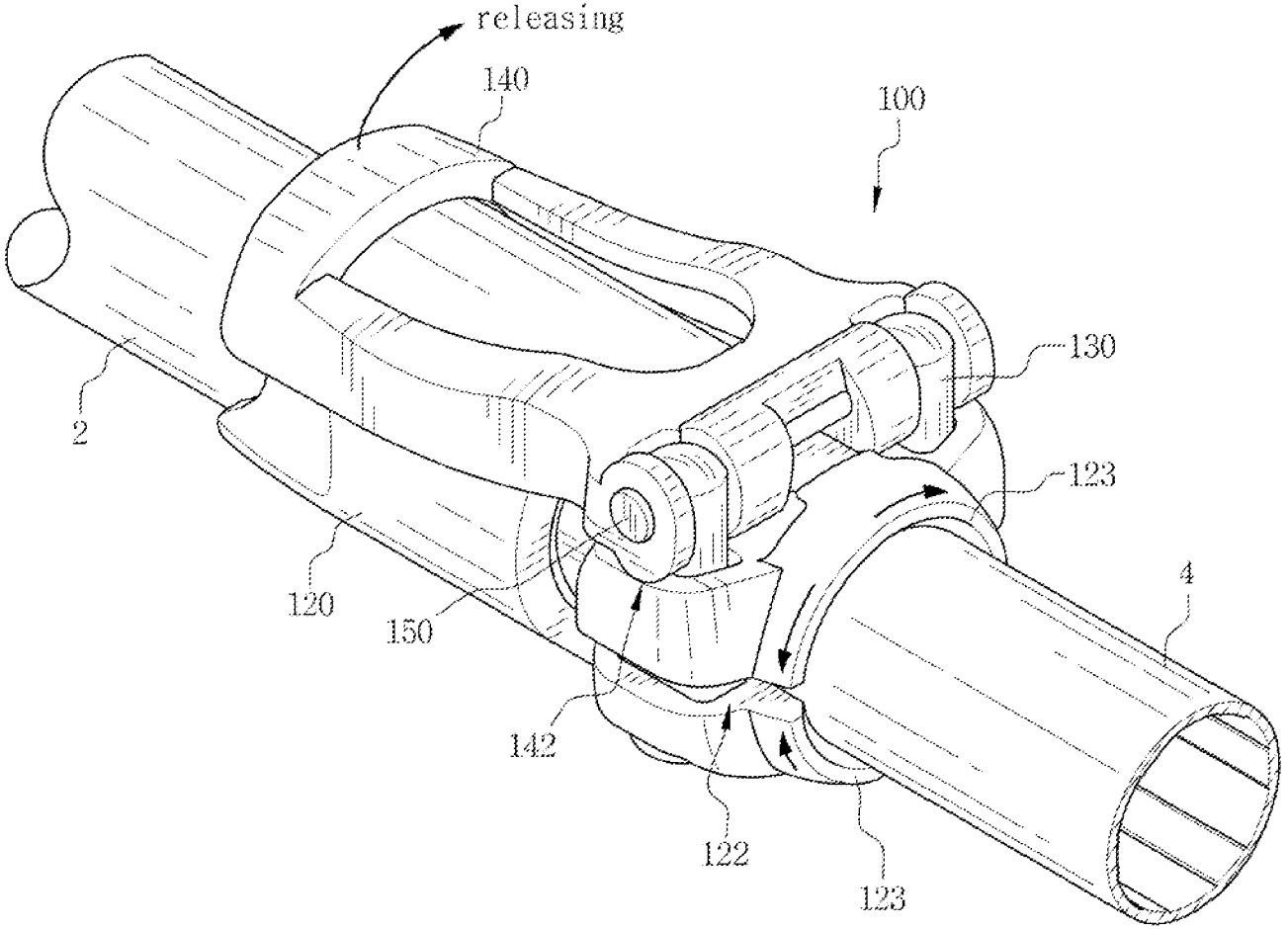
FIG. 3 (PRIOR ART)
FIG. 3 is a perspective view illustrating another example of a cam lever type locking device of the related art.
Figure 4:
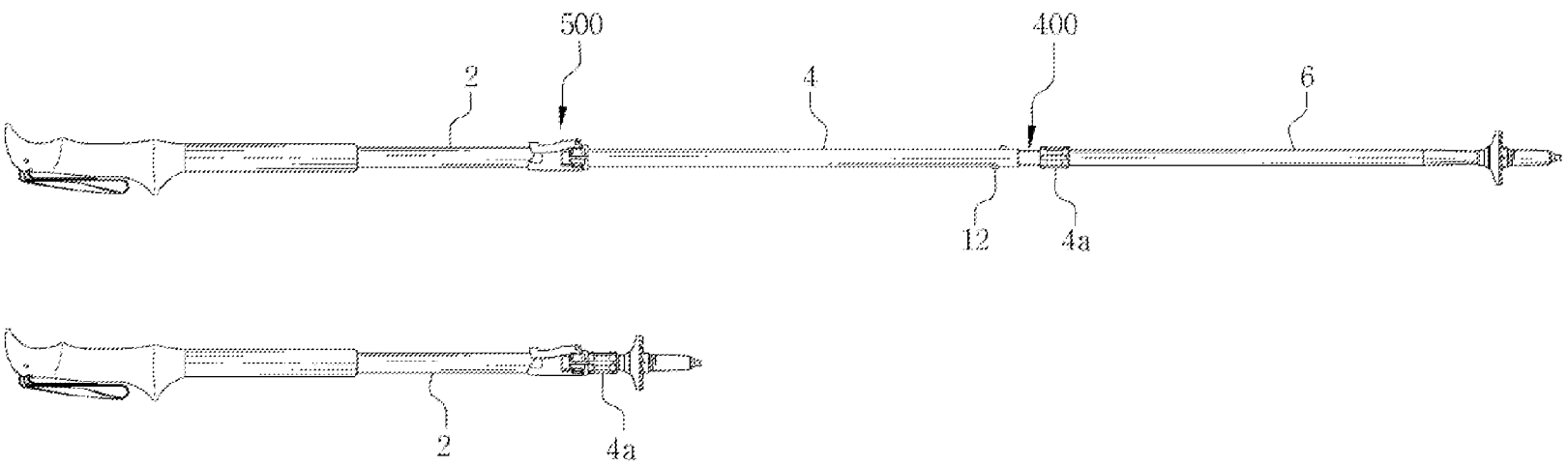
FIG. 4 is a perspective view illustrating an example of a stick according to the disclosure.

FIG. 4 is a perspective view illustrating a stick according to an embodiment of the disclosure. The disclosure will be described by giving the same reference numerals to the same components as those of FIGS. 1 to 3.

Figure 2:
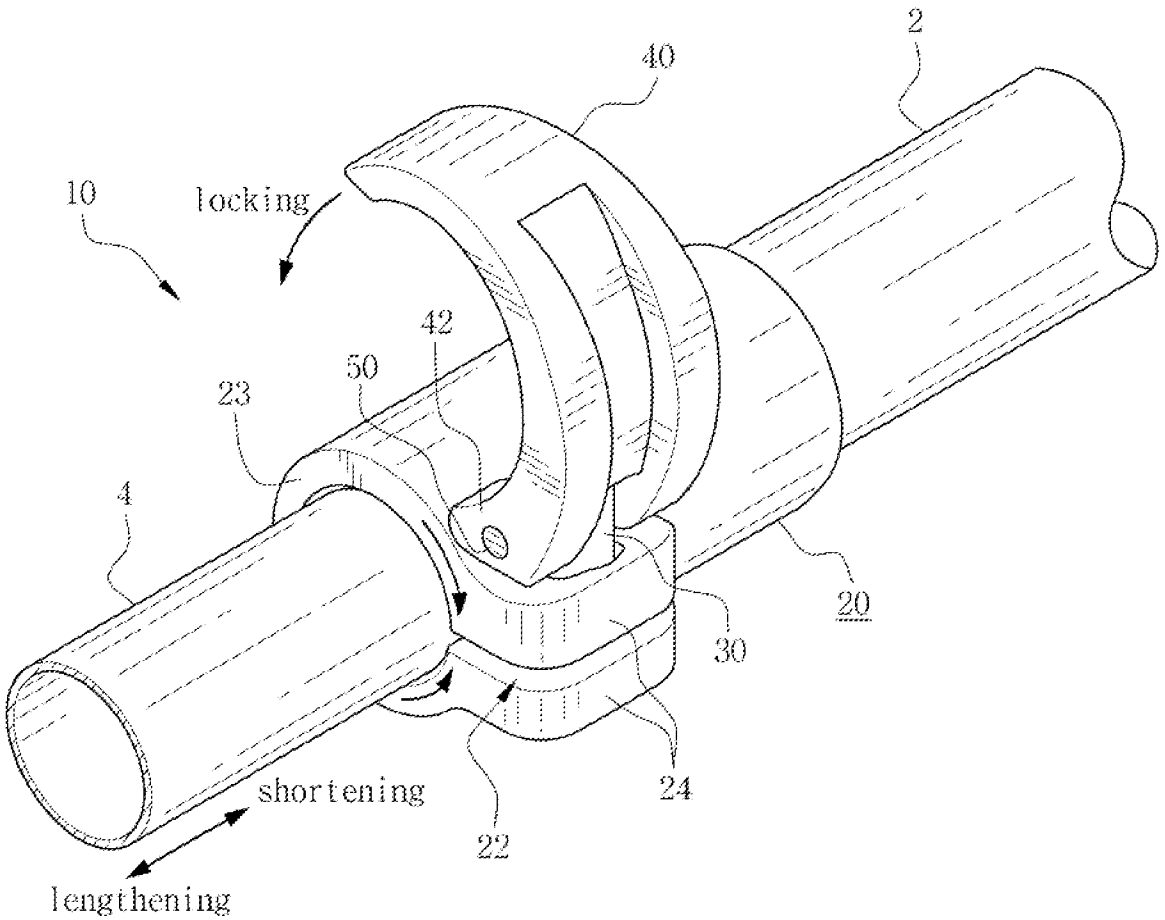
FIG. 2 (PRIOR ART)
FIG. 2 is a perspective view illustrating an example of a cam lever type locking device of the related art.

Hereinafter, a cam lever type locking device 500 will be described with reference to an example having the same configuration as that of the locking device 100 described by referring to FIG. 3, but the disclosure may also be applied to the locking device 10 described by referring to FIG. 2.

Referring to FIG. 4, the cam lever type locking device 500 is applied to at least one or more of plural connection tubes 2, 4, 6 . . . and plural connection portions.

The upper connection tube 2 of the connection portion provided with the cam lever type locking device 500 has a large diameter, and the lower connection tube 4 has the smaller diameter. The lower connection tube 4 is inserted into the front end portion of the upper connection tube 2 according to a shaft-hole connection type.

The 'lengthened position' means a state where the lower connection tube 4 is taken out, as shown at the upper side of FIG. 4. The 'shortened position' means a state where the lower connection tube 4 is pressed into the upper connection tube 2 so that a sleeve 4*a* of the front end of the lower connection tube 4 contacts the front end portion of the upper connection tube 2 or reaches the approximate contact position, as shown at the lower side of FIG. 4.

A contracted tube portion 400 having a predetermined length is formed at the front end portion of the lower connection tube 4, that is, a position adjacent to the sleeve 4*a*.

The contracted tube portion 400 is formed at a point where the contracted tube portion contacts a circular-arc engagement portion (to be described later) of the cam lever type locking device 500 while the lower connection tube 4 is pressed into the shortened position. Since the circular-arc engagement portion of the locking device engages with the portion of which the outer diameter decreases due to the contracted tube portion 400 at the shortened position, the locking force (the gripping force) acting on the circular-arc engagement portion decreases. Accordingly, even when the stick is accommodated in the shortened state for a long period of time, the plastic deformation of the circular-arc engagement portion may be prevented.

Figure 5:
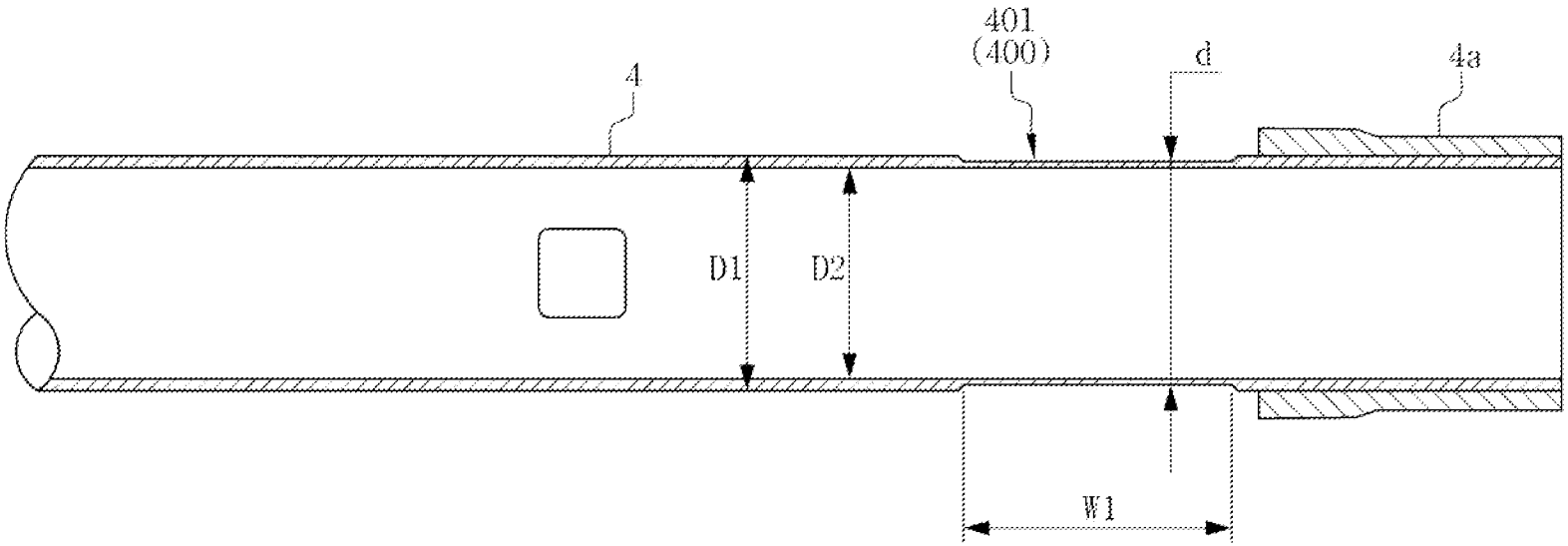
FIG. 5 is a main cross-sectional view illustrating a connection tube according to a first embodiment of the disclosure.
Figure 6:
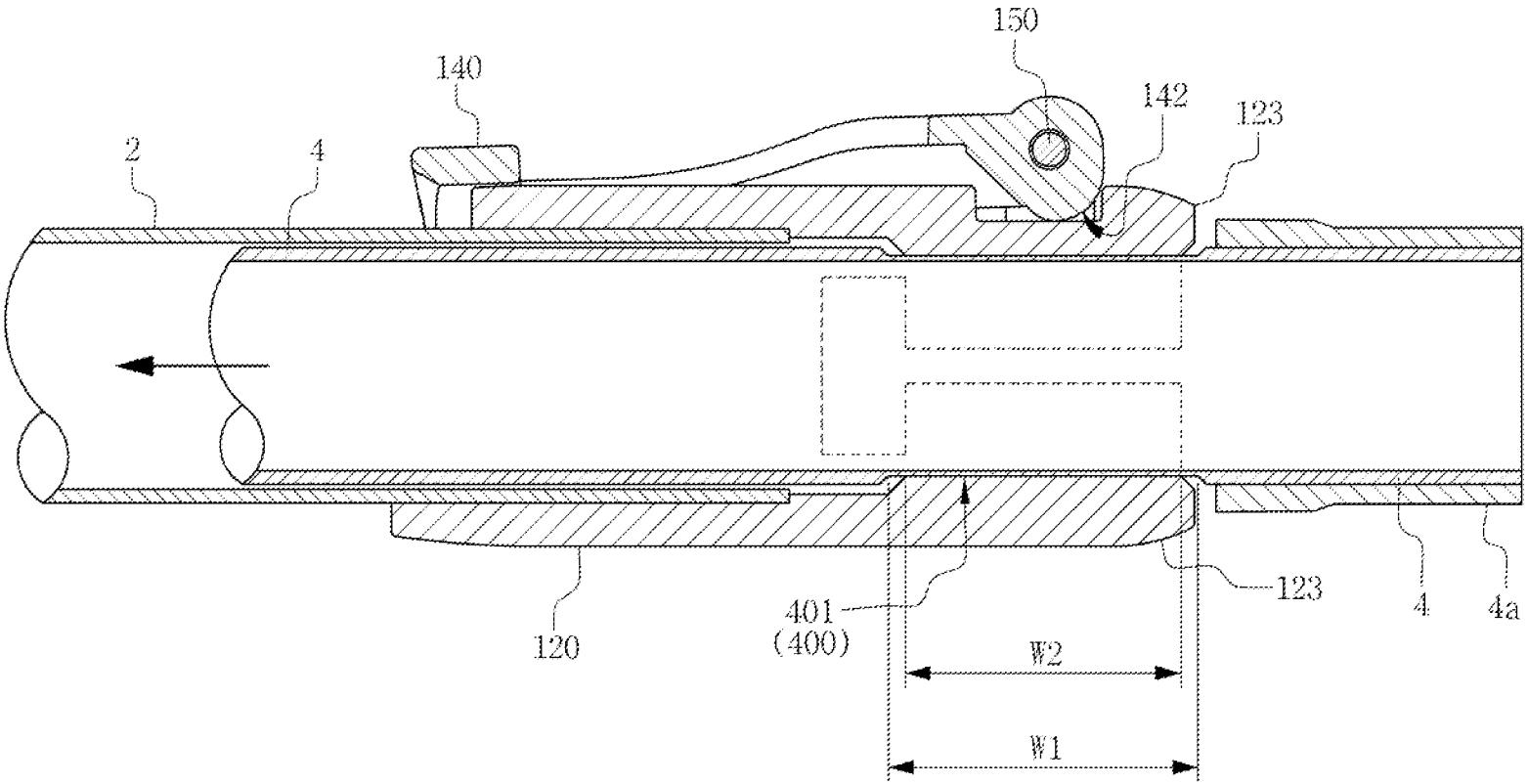
FIG. 6 is a main cross-sectional view illustrating an assembly state of a connection tube and a locking device according to the first embodiment of the disclosure.

FIG. 5 is a main cross-sectional view illustrating a connection tube according to a first embodiment of the disclosure, and FIG. 6 is a main cross-sectional view illustrating an assembly state of the connection tube and the locking device.

As shown in FIGS. 5 and 6, the contracted tube portion 400 which is formed by decreasing the outer diameter D1 of the lower connection tube 4 is formed at the shortened position (the position adjacent to the sleeve 4*a*) adjacent to the front end portion of the lower connection tube 4.

The width W1 of the contracted tube portion 400 is formed so as to be wider than the width W2 of the engagement portion 123 formed in the gripping tube 120 of the cam lever type locking device in the axial direction so that the entire engagement portion 123 contacts the contracted tube portion 400.

Referring to FIG. 6, when a cam lever 140 is locked at the shortened position, the cam surface 142 allows the engagement portion 123 of the gripping tube 120 pressurizes and tightens the contracted tube portion 400 which is formed by decreasing the diameter of the lower connection tube 4, so that a small locking force is applied and a stretching phenomenon is reduced compared to the case of tightening the other portion of the lower connection tube 4, that is, the portion having a large outer diameter D1.

As for the shape of the contracted tube portion 400 shown in FIGS. 5 and 6, the lower connection tube 4 is manufactured, and then the outer diameter portion is cut so as to be recessed, thereby forming a contracted tube portion 401. Accordingly, the outer diameter D1 decreases to the small diameter d in a state where the inner diameter D2 of the lower connection tube 4 is maintained as it is.

Figure 7:
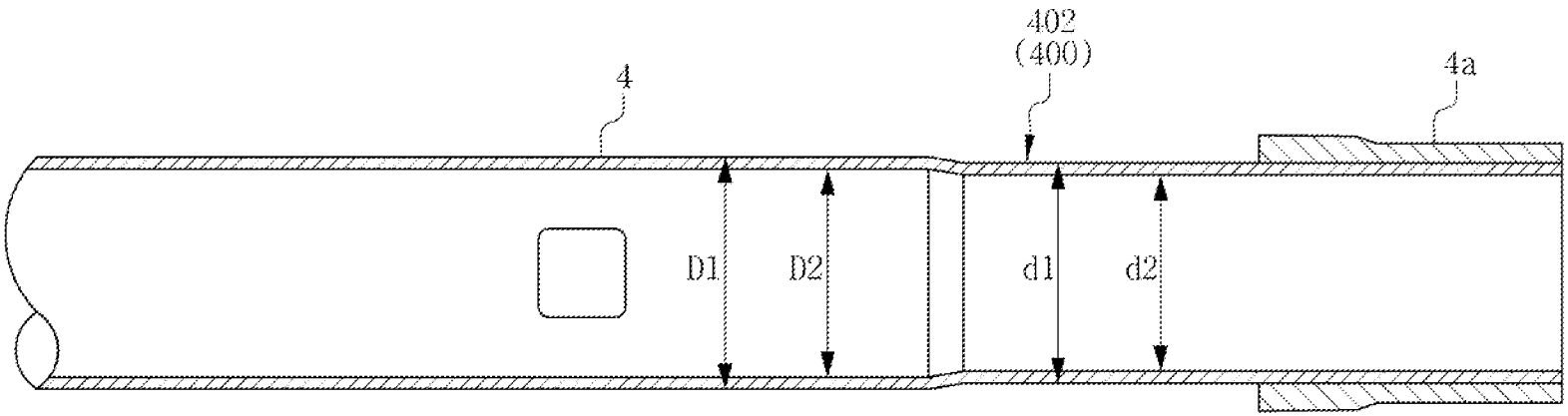
FIG. 7 is a main cross-sectional view illustrating a connection tube according to a second embodiment of the disclosure.
Figure 8:
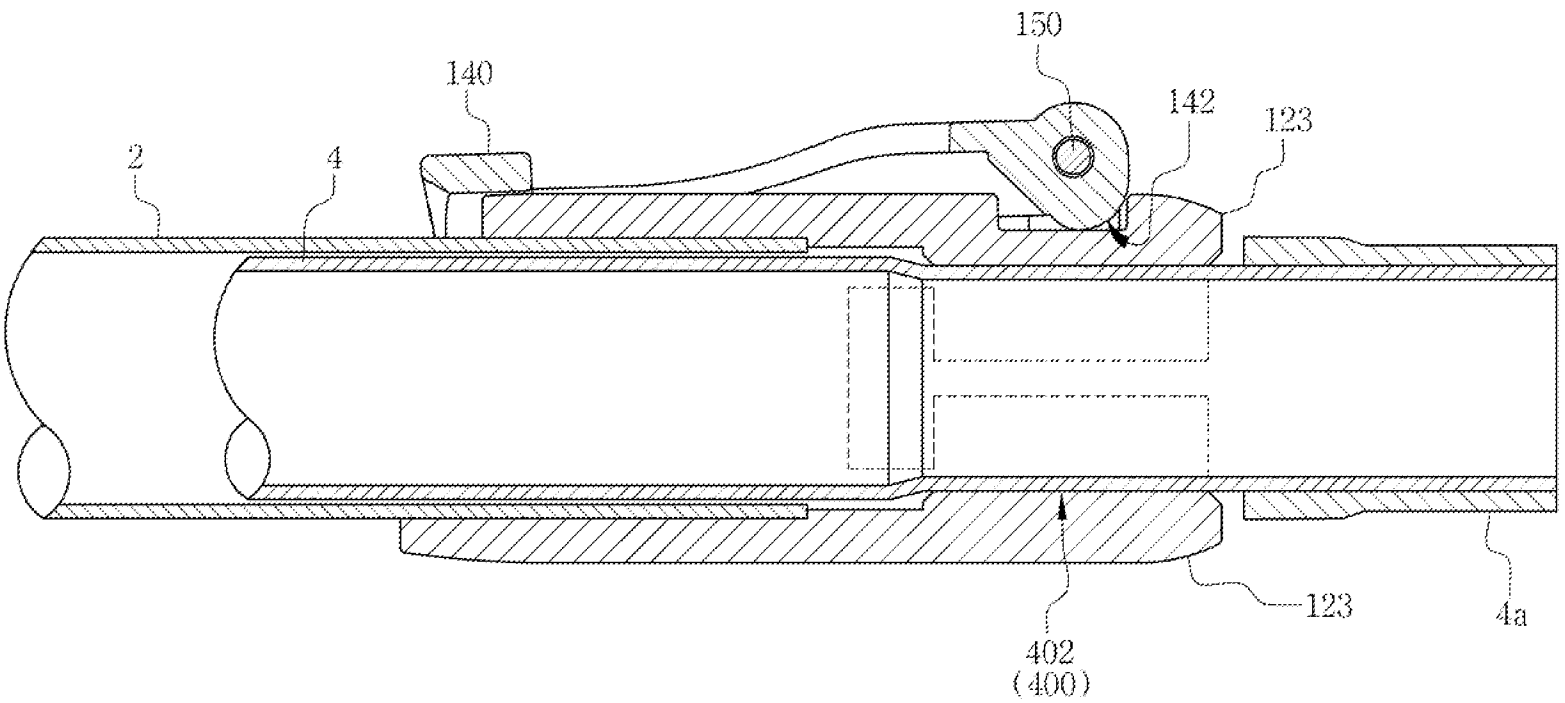
FIG. 8 is a main cross-sectional view illustrating an assembly state of a connection tube and a locking device according to the second embodiment of the disclosure.

FIG. 7 is a main cross-sectional view illustrating a connection tube according to a second embodiment of the disclosure, and FIG. 8 is a main cross-sectional view illustrating an assembly state of the connection tube and the locking device.

The embodiment has the same configuration as that of first embodiment except for the shape of the contracted tube portion 400.

That is, in the embodiment, instead of the contracted tube portion 401 which is formed by cutting the lower connection tube 4 so as to be recessed through machining, it will be described that the front end portion of the lower connection tube 4 which has manufactured already is pressurized by dies or casting or pressing so as to form a contracted tube portion 402 which is decreased in diameter.

According to the tube contracting method, the diameter of the entire tube is directly decreased so that the thickness of the lower connection tube 4 does not change or substantially does not change. That is, the outer diameter d1 and the inner diameter d2 of the contracted tube portion 402 are directly decreased to the outer diameter D1 and the inner diameter D2 of the lower connection tube 4 without any change in thickness compared to the original lower connection tube 4.

Even in the case of the second embodiment, as in the first embodiment, when the cam lever 140 is locked in a state where the lower connection tube 4 is pressed into the upper connection tube 2 so as to reach the shortened position, the engagement portion 123 of the gripping tube 120 pressurizes and tightens the contracted tube portion 402 which is decreased in diameter. Accordingly, a small locking force is applied and a stretching phenomenon is reduced compared to the case where the other portions of the lower connection tube 4, that is, the portion having a large outer diameter D1 is tightened.

According to the stick with the cam lever type locking device of the disclosure, since the contracted tube portion which is formed by decreasing the outer diameter of the tube is gripped by the circular-arc engagement portion of the cam lever type locking device in a state where the lower connection tube is pressed into the shortened position, the locking force (the gripping force) acting on the circular-arc engagement portion decreases. Accordingly, it is possible to prevent the plastic deformation in which the circular-arc engagement portion is stretched even in a case where the stick is accommodated for a long period of time.

While the exemplary embodiments have been shown and described, it will be understood by those skilled in the art that various changes in form and details may be made thereto without departing from the spirit and scope of the present disclosure as defined by the appended claims.

What is claimed is:

1. A stick, comprising:

an upper connection tube;

a lower connection tube having a diameter smaller than a diameter of the upper connection tube, and being inserted into the upper connection tube; and a gripping tube being fixed to a front end portion of the upper connection tube, wherein the gripping tube has a circular-arc engagement portion formed by a front-end cut portion of the gripping tube and a cam lever for tightening or loosening the circular-arc engagement portion, the circular-arc engagement portion is tightened or loosened by an operation of the cam lever so that the lower connection tube is fixed in a pressurized and gripped state or is released in an un-pressurized and un-gripped state, the lower connection tube includes a main tube portion and a contracted tube portion having an outer diameter smaller than an outer diameter of the main tube portion, the contracted tube portion is formed in the lower connection tube at a portion with which the circular-arc engagement portion comes into contact when the lower connection tube is pressed into the upper connection tube so as to reach a shortened position, and has an axial length larger than an axial length of the circular-arc engagement portion, when the cam lever is locked at a lengthened position in which the lower connection tube is taken out from the upper connection tube for using the stick, the circular-arc engagement portion comes into contact with the main tube portion, and when the cam lever is locked at the shortened position, the circular-arc engagement portion comes into contact with the contracted tube portion having a small outer diameter.

2. The stick according to claim 1, wherein the contracted tube portion has an inner diameter equal to an inner diameter of the main tube portion.

3. The stick according to claim 1, wherein the contracted tube portion has an inner diameter smaller than an inner diameter of the main tube portion.

* * * * *